United States Patent [19]

Wood

[11] Patent Number: 4,731,956

[45] Date of Patent: Mar. 22, 1988

[54] FLOOR POLISHING MACHINE

[75] Inventor: David W. Wood, Rockford, Minn.

[73] Assignee: Advance Machine Company, Plymouth, Minn.

[21] Appl. No.: 922,084

[22] Filed: Oct. 21, 1986

[51] Int. Cl.[4] ..... B24B 7/18

[52] U.S. Cl. ..... 51/177; 51/273; 51/385

[58] Field of Search ..... 51/170 R, 170 T, 174, 51/177, 273; 15/385, 49 R, 98

[56] References Cited

U.S. PATENT DOCUMENTS

| | | |
|---|---|---|
| 548,201 | 10/1895 | Hvass . |
| 935,558 | 9/1909 | Spangler . |
| 1,093,820 | 4/1914 | Beach . |
| 1,763,365 | 6/1930 | Nobbs . |
| 1,857,240 | 5/1932 | Dittmar . |
| 2,415,372 | 2/1947 | Salt et al. . |
| 2,668,976 | 2/1954 | Beach . |
| 2,949,619 | 8/1960 | Holt . |
| 3,065,490 | 11/1962 | Arones . |
| 3,417,420 | 12/1968 | Rock . |
| 3,619,849 | 11/1971 | Jones . |
| 3,619,954 | 11/1971 | Miller . |
| 3,678,532 | 7/1972 | Boyd . |
| 3,974,598 | 8/1976 | Guidry . |
| 4,148,110 | 4/1979 | Moen . |
| 4,178,654 | 12/1979 | Mitchell . |
| 4,307,480 | 12/1981 | Fallen . |
| 4,322,866 | 4/1982 | Brazzale . |
| 4,358,868 | 11/1982 | Cook, Jr. . |
| 4,365,377 | 12/1982 | Todd et al. . |
| 4,598,440 | 7/1986 | Wilson . |

*Primary Examiner*—Roscoe V. Parker

*Attorney, Agent, or Firm*—Petersonm, Wicks, Nemer & Kamrath

[57] ABSTRACT

A cleaning apparatus according to the teachings of the present invention disclosure is shown in its most preferred form of a floor polishing machine having a polishing member rotatably mounted to a platform. The polishing member is raised off the floor surface by lift levers and lever extensions pivotally mounted to the chassis having their first ends pivotally mounted to the platform of the polishing member and their second ends pivotally attached to a vertically reciprocal rod biased by a spring. The polishing member automatically lowers due to the suction created by the polishing member forcing the air from underneath the center of the polishing member during rotation and against the bias of the spring. The rigid polishing member is allowed to follow the floor surface due to the pivotal mounting of the platform to the ends of the lift levers and to a parallelogram assembly. To control dust and debris, a vacuum chamber is provided surrounding the polishing member, with the vacuum being created by an impeller formed on and rotating with the polishing member and within a pressurizing chamber for drawing air out of the vacuum chamber and forcing it through a filtering dust bag.

24 Claims, 5 Drawing Figures

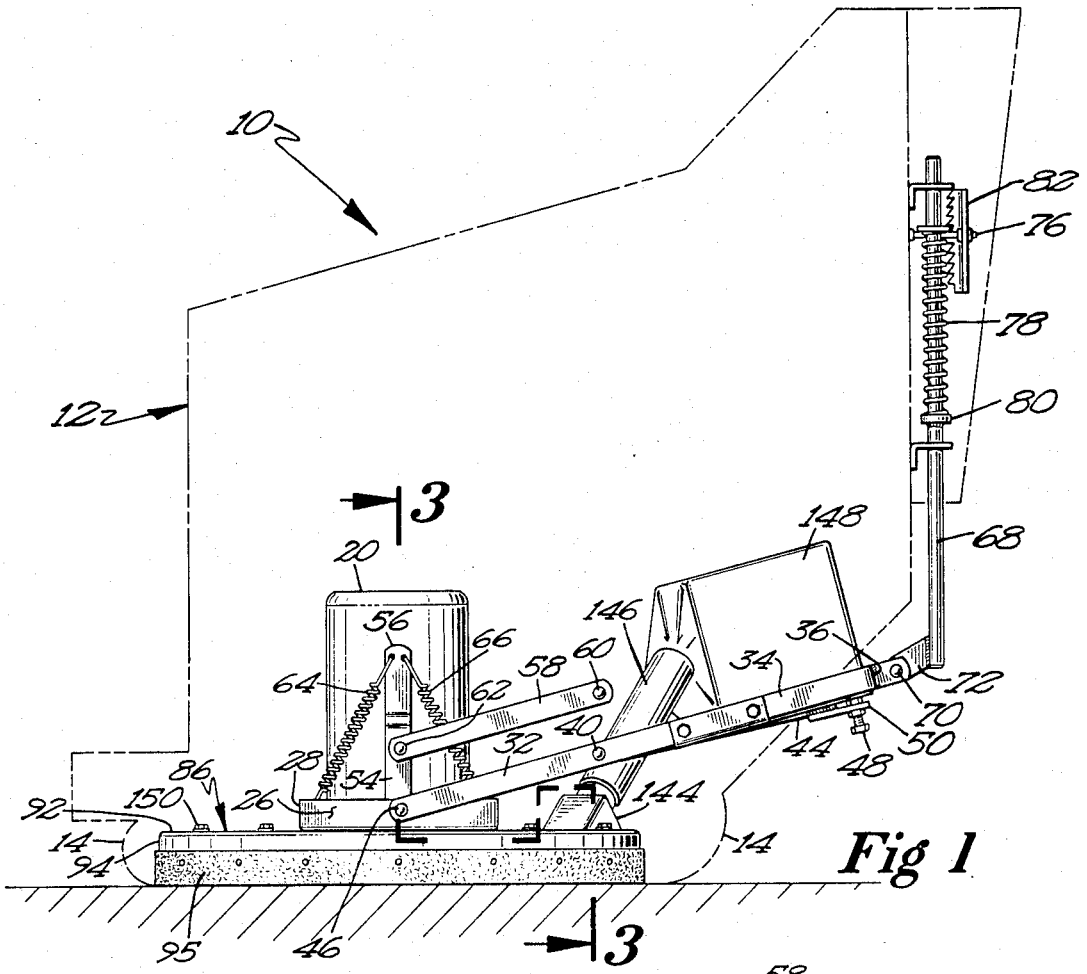
Fig 1
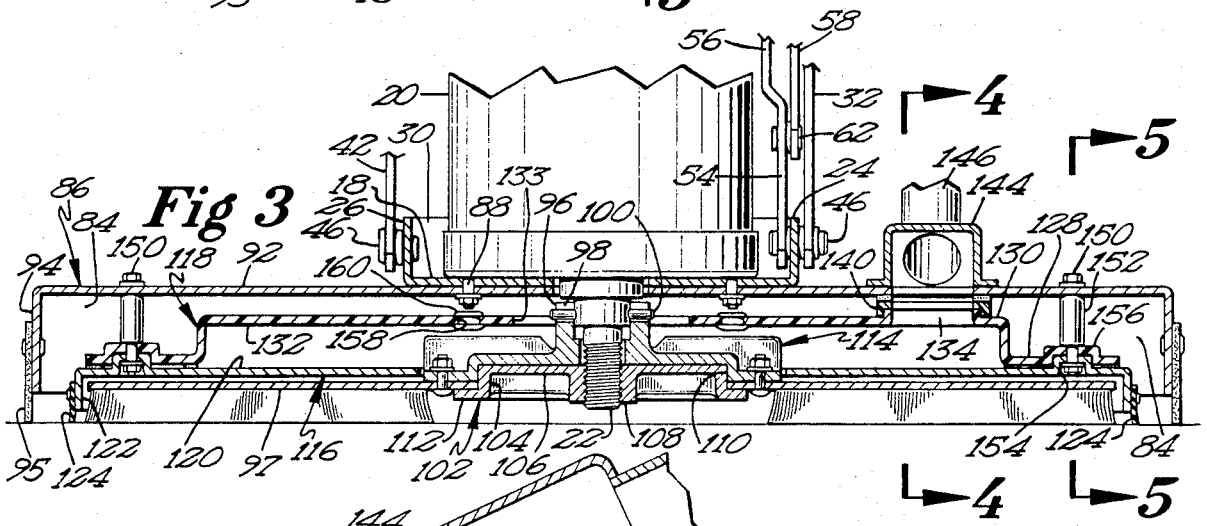
Fig 3
Fig 4

FLOOR POLISHING MACHINE

BACKGROUND

The present invention relates to apparatus for cleaning, particularly to apparatus for cleaning floor surfaces, and specifically to a unique and novel floor polishing machine.

High speed burnishing is a floor polishing method using a very fine abrasive disc rotating at 1000 RPM's or more to produce a high "wet look" glass appearance on the floor. Typically a high solids content floor finish material is spread in a thin layer on the floor, allowed to harden, and then burnished with a high RPM burnishing machine. The burnishing process removes the top particles of the floor finish with the fine abrasive rotating disc, producing a smooth glossy appearance. In the process, the top layer of floor finish is removed in the form of a very fine powder. This powder often becomes airborne because of the air turbulence created by the high speed rotation of the disc. This is undesirable because the powder and dust then settles back onto the floor and on furniture and must be removed with a dust mop, vacuum cleaner or similar means.

The orientation of the burnishing disc in relation to the transport wheels requires that the burnishing disc be raised off the floor when transporting the machine from one location to another in the non-operating mode. This is necessary to avoid damaging the disc when the machine is moved over door thresholds, ramps, elevator door gaps, and the like. Prior to the present invention, the burnishing disc was raised manually by the operator. One disadvantage of a manually operated means of raising the disc off the floor is that the operator may forget or neglect to engage the lift mechanism.

Thus a need has arisen for a floor polishing machine which provides dust and debris control and which automatically raises the burnishing disc off the floor in a non-operating mode.

SUMMARY

The present invention solves these and other needs and problems in the field of cleaning by providing, in the preferred form, a floor polishing machine having a platform rotatably mounted to a lift arm for rotatably mounting a polishing member for rotation about a polishing axis for polishing the floor surface when a chassis is moved along the floor. A parallelogram is formed by the chassis, a lift lever, the lift arm, and a parallelogram bar for maintaining the lift arm in a vertical orientation. The pivotal mounting of the platform to the lift arm allows the platform and the polishing member to follow the floor surface when the chassis is moved along the floor regardless of the unevenness of the floor surface.

In another aspect, the present invention solves these and other needs and problems in the field of cleaning by providing, in the preferred form, a floor polishing machine having a platform for rotatably mounting a polishing member for rotation about a polishing axis for polishing the floor surface when a chassis is moved along the floor. Further provided is a lift lever pivotally mounted to the chassis about a first pivot axis and having a free end attached to the platform and a lever extension contiguous with the lift lever and extending beyond the first pivot axis. The floor polishing machine further includes provisions for biasing the free end of the lever extension in a downward direction for raising the polishing member off the floor surface when the polishing member is not rotating, with the rotation of the polishing member forcing air from beneath the rotating polishing member creating a vacuum under the polishing member to place a downward suction on the polishing member and the platform to which it is rotatably mounted and counteracting with the biasing means to place an even force on the floor surface by the polishing member regardless of the unevenness of the floor surface.

In a further aspect, the present invention solves these and other needs and problems in the field of cleaning by providing, in the preferred form, a vacuum chamber surrounding a rotating working member for extracting any dust from the work surface around the perimeter of the rotating working member and depositing it in a dust collection device.

It is thus an object of the present invention to provide a novel cleaning apparatus.

It is further an object of the present invention to provide such a novel cleaning apparatus incorporating a dust collection/control system.

It is further an object of the present invention to provide such a novel cleaning apparatus having a dust collection/control system without requiring specially manufactured polishing pads and the like.

It is further an object of the present invention to provide such a novel cleaning apparatus having a dust collection/control system utilizing a vacuum chamber located concentrically of the rotating working member.

It is further an object of the present invention to provide such a novel cleaning apparatus having a dust collection/control system utilizing an impeller located on the top of the rotating working member.

It is further an object of the present invention to provide such a novel cleaning apparatus which allows a rigid polishing member to follow the floor surface regardless of the unevenness of the floor surface.

It is further an object of the present invention to provide such a novel cleaning apparatus utilizing a parallelogram to maintain the polishing axis of the polishing member generally vertical.

It is further an object of the present invention to provide such a novel cleaning apparatus which automatically raises the polishing member off the floor surface in a non-operating mode.

It is further an object of the present invention to provide such a novel cleaning apparatus which places even cleaning pressure on the floor surface regardless of the unevenness of the floor surface.

It is further an object of the present invention to provide such a novel cleaning apparatus allowing for easy access for motor maintenance.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where:

FIG. 1 shows a side elevation view of a floor polishing machine according to the teachings of the present invention, with portions being shown in phantom.

FIG. 3 shows a cross-sectional view of the floor polishing machine of FIG. 1 according to section line 3—3 of FIG. 1.

FIG. 4 shows a partial, cross-sectional view of the floor polishing machine of FIG. 1 according to section line 4—4 of 3.

Figures 2, 5:
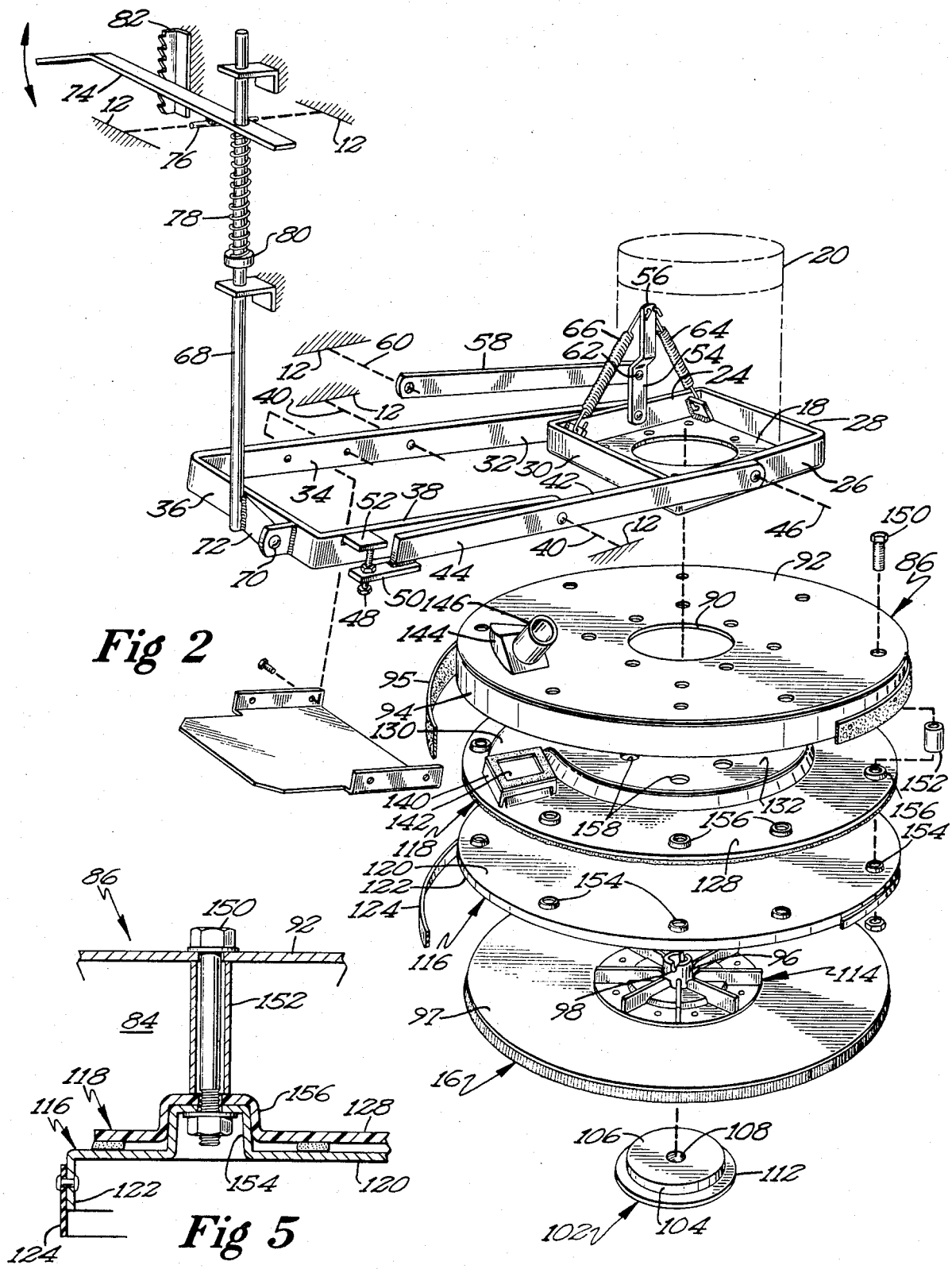
FIG. 2 shows a partial, exploded perspective view of the floor polishing machine of FIG. 1.
FIG. 5 shows a partial, cross-sectional view of the floor polishing machine of FIG. 1 according to section line 5—5 of FIG. 3.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "upper", "lower", "first", "second", "front", "rear", "end", "edge", "forward", "inside", "outside", and similar terms are used herein, it should be understood that these terms have reference only to the structure shown in the drawings as it would appear to a person viewing the drawings and are utilized only to facilitate describing the invention.

DESCRIPTION

A floor machine is shown in the drawings in its most preferred form as a floor polishing machine according to the teachings of the present invention and is generally designated 10. Floor polishing machine 10 generally includes a chassis 12 adapted to be moved along a floor or other cleaning surface such as by wheels 14. A polishing member 16 for polishing the floor surface when rotated about a polishing axis when chassis 12 is moved along the floor is provided in its most preferred form as a holder of the rigid type for a polishing pad, brush or the like. A platform 18 is further provided in the most preferred form for mounting a motor 20 having a vertically orientated output shaft 22 which forms the polishing axis and to which polishing member 16 is non-rotatably secured. Platform 18 in the preferred form includes an upstanding, perimeter frame including frame sides 24 and 26 and front and rear frame edges 28 and 30.

Floor polishing member 10 further includes in its most preferred form a first lift lever 32, a lever extension 34 contiguous with first lift lever 32, a connecting member 36 secured to the free end of lever extension 34 and extending generally perpendicularly therefrom, and an adjustment arm 38 extending from the opposite end of connecting member 36 generally spaced from and parallel to lever extension 34. In the most preferred form, lift lever 32, lever extension 34, connecting member 36, and adjustment arm 38 are formed integrally together from a single member bent to the preferred configuration. Lift lever 32 and adjustment arm 38 are pivotally mounted to chassis 12 about a first pivot axis 40 extending through the free end of adjustment arm 38 and lift lever 32 adjacent to its interconnection to lever extension 34.

Floor polishing member 10 further includes in its most preferred form a second lift lever 42 and a second lever extension 44 contiguous and integral with lift lever 42. In the most preferred form, the free ends of lift levers 32 and 42 are pivotally mounted to platform 18 about a second pivot axis 46 which in the most preferred form extends through frame sides 24 and 26 intermediate frame edges 28 and 30. Lift lever 42 is pivotally mounted to chassis 12 about first pivot axis 40 adjacent to its interconnection to lever extension 44. Provisions are further provided in the most preferred form for adjusting the angular orientation of lever extension 44 and adjustment arm 38 from first pivot axis 40 and in the most preferred form includes a bolt 48 threadably received in a plate 50 secured to the free end of lever extension 44 which abuts with an abutment 52 formed on adjustment arm 38. Thus, threading bolt 48 into and out of plate 50 allows the free end of lift lever 42 pivotally mounted to platform 18 about pivot axis 46 to be raised or lowered relative to the free end of lift lever 32 and thus changing the angular orientation of pivot axis 46 with respect to chassis 12 and the floor surface.

Floor polishing member 10 also includes in its most preferred form a lift arm 54 and a lift arm extension 56 contiguous and integral with lift arm 54. In the most preferred form, the free end of lift arm 54 is pivotally mounted to platform 18 about second pivot axis 46.

Floor polishing member 10 additionally includes in its most preferred form a parallelogram bar 58 pivotally mounted by its first end to chassis 12 about a third pivot axis 60 and pivotally mounted by its second end to lift arm 54 about a fourth pivot axis 62. In the preferred form, pivot axes 40 and 60 lie along a vertical line and are spaced a distance. Pivot axes 46 and 62 are spaced a distance equal to the distance between pivot axes 40 and 60. The distance between pivot axes 40 and 46 is also equal to the distance between pivot axes 60 and 62. Therefore, lift levers 32 and 42, lift arm 54, parallelogram bar 58, and chassis 12 between pivot axes 40 and 60 form a parallelogram for maintaining lift arm 54 in a vertical orientation.

Further, floor polishing machine 10 includes in its most preferred form provisions for resiliently maintaining platform 18 at the desired angular relationship to lift levers 32 and 42 allowing polishing member 16 to tilt about pivot axis 46 to follow the floor surface when chassis 12 is moved along the floor with polishing member 16 engaging the floor and allowing polishing member 16 to be spaced from the floor surface in its raised, transport position. In the most preferred form, the resiliently maintaining provisions are shown as first and second springs 64 and 66 extending between the free end of lift arm extension 56 and front and rear edges 28 and 30 of platform 18 respectively.

In its most preferred form, floor polishing machine 10 further includes provisions for pivoting lift levers 32 and 42 about pivot axis 40 accomplished in the preferred form by biasing lift levers 32 and 42 to pivot about pivot axis 40 for elevating the free ends of lift levers 32 and 42. Particularly, lever extensions 34 and 44 are biased in a downward direction according to the teachings of the present invention. Specifically, a lift rod 68 is reciprocally, vertically mounted in chassis 12 and pivotally connected by ears 70 and 72 to the free ends of lever extensions 34 and 44 by their interconnection to connecting member 36. In the most preferred form, an adjustment lever 74 is pivotally mounted to chassis about a pivot axis 76 located between its ends. A spring 78 is provided between the first end of adjustment lever 74 and a collar 80 for biasing lift rod 68 vertically downwardly. A rachet member 82 is further provided for holding the second end of adjustment lever 74 in one of a plurality of pivotal positions for varying the bias of spring 78 and thus the biasing of lift rod 68.

In operation, it can then be noted that due to the force of gravity, motor 20 tends to pivot lift levers 32 and 42 about pivot axis 40 and against the bias of spring 78. This gravitational force can be countered in whole or in part by suitable provisions such as springs extending between chassis 12 and motor 20. Further, the rotation of polishing member 16 at high rotational speeds (approximately 2500 RPM's) forces the air from underneath the center of polishing member 16 creating a vacuum thereunder to place a downward suction on polishing member 16 also tending to pivot lift levers 32 and 42 about pivot axis 40 and against the bias of spring 78. Similarly, the bias of rod 68 downwardly by spring 78 tends to pivot lift levers 32 and 42 about pivot axis 40 to raise platform 18 in chassis 12, with lever extensions 34 and 44 giving spring 78 a mechanical, leverage force advantage.

It can then be appreciated that floor polishing machine 10 has two modes of operation, i.e. a working mode when polishing member 16 is rotating and polishing the floor surface and a transport mode when polishing member 16 is not rotating and is spaced from the floor surface to avoid damage to polishing member 16 when floor polishing machine 10 is moved over door thresholds, ramps, elevator door gaps, and the like. It should then be noted that floor polishing machine 10 automatically raises and lowers polishing member 16 between its working and transport modes depending upon the rotation of polishing member 16. Specifically, when polishing member 16 is not rotating, spring 78 biases platform 18 and polishing member 16 upwardly against any gravitational forces on platform 18 such that polishing member 16 is spaced from the floor surface. However, when polishing member 16 is rotating, platform 18 and polishing member 16 move downwardly against the bias of spring 78 due to the suction created by rotation of polishing member 16. Therefore, during rotation of polishing member 16, the downward movement of platform 18 created by the suction effect and gravity is countered by the biasing force exerted by spring 78 which tends to raise platform 18 upward. Furthermore, it can be appreciated that platform 18 is urged upwardly by spring 78 with a known spring constant. Likewise, the downward movement force created by the suction effect and gravity is substantially constant for the same rotation speeds of polishing member 16. Therefore, it can be appreciated that a calculated balance can be created between the force of spring 78 to lift polishing member 16 and the characteristic of polishing member 16 to pull itself down due to the suction effect created. Therefore, pressure placed on the floor surface by polishing member 16 is substantially constant regardless of the unevenness of the floor surface and the pressure polishing member 16 places upon the floor surface is controlled automatically and without being dependent on operator involvement. Further, this cleaning pressure of polishing member 16 may be varied by pivoting adjustment lever 74 into different positions in rachet member 82. Control of cleaning pressure is especially important for controlling the amperage draw of motor 20. In addition to acting as an abutment for spring 78, collar 80 allows the tension on spring 78 to be varied by moving collar 80 on rod 68 and also abuts with chassis 12 to limit the amount of upward movement of polishing member 16 under the bias of spring 78 to insure that a partial vacuum is created when polishing member 16 is initially rotated to create the suction effect for pulling polishing member 16 downward.

By changing the orientation of pivot axis 46 utilizing bolt 48, the cleaning pressure may be variably distributed on polishing member 16. Therefore, the distribution of cleaning pressure may be varied allowing the rotation of polishing member 16 to assist propelling chassis 12 along the floor.

In the preferred construction of chassis 12, chassis 12 may be tilted backwards to raise polishing member 16 and the front set of wheels 14 off the floor. After removal of polishing member 16 and any associated parts, it is possible according to the teachings of the present invention to tilt motor 20 and platform 18 to allow replacement of the motor brushes after pivot axis 62 is removed between lift arm 54 and parallelogram bar 58. Access in this manner does not require removal of the batteries of floor polishing machine 10 to replace brushes for motor 20 or to do other maintenance on motor 20, a major time and energy saving advantage gained by the present invention.

Floor polishing member 10 according to the teachings of the present invention includes provisions for creating a vacuum chamber 84 surrounding polishing member 16 and located around and concentrically to floor polishing member 16. Specifically, a shield 86 is provided secured to platform 18 by bolts 88 with shaft 22 extending through central opening 90. Specifically, shield 86 is closed for air flow therethrough and includes a planar portion 92 of a circular configuration in its most preferred form and includes a downwardly extending flange 94 having a size complementary to but larger than polishing member 16, with flange 94 including a flexible skirt 95 dependingly mounted therefrom. Skirt 95 may be formed of filter media allowing air flow therethrough.

Polishing member 16 according to the teachings of the present invention includes a hub portion 96 for slidable receipt of shaft 22 of motor 20 and an annular disc 97 of rigid construction and forming the backing for polishing pad, brush, or the like of polishing member 16. Portion 96 includes a radial slot 98 formed on its upper end of a size complementary to and for slidably receiving a pin 100 radially extending through shaft 22 for rotatably relating hub portion 96 of polishing member 16 to shaft 22 of motor 20. For purposes of securing polishing member 16 to shaft 22 of motor 20, a fastening element 102 is provided including a cylindrical wall 104 terminating in an end wall 106 having a central portion 108 for threadable receipt on shaft 22 of motor 20. Finger holds such as portions of end wall 106 bent outwardly as shown may be formed for assisting threadably turning element 102 to shaft 22. In its most preferred form, portion 96 includes a recessed portion 110 of a size and shape complementary to and for receipt of walls 104 and 106. Fastening element 102 further includes a flange 112 extending from wall 104 for abutting with disc 97 of polishing member 16 and may sandwich the polishing pad or the like therebetween.

Hub portion 96 further includes an impeller 114 including a plurality of radially extending circumferentially spaced fan blades formed on its upper surface and opposite to the polishing pad, brush, or the like of polishing member 16.

Floor polishing machine 14 further includes according to the teachings of the present invention an air barrier 116 and a centrifugal fan housing 118. Air barrier 116 is closed for air flow therethrough and includes a planar portion 120 of a circular configuration in its most preferred form and includes a downwardly extending flange 122 having a size complementary to and generally the same as but slightly larger than disc 97 of polishing member 16, with flange 122 including a flexible skirt 124 dependingly mounted therefrom. Skirt 124 may be formed of air impervious material such as rubber and prevents loose dust and dirt from being blown away by polishing member 16. Air barrier 116 further includes a central opening of a size for receipt of impeller 114 such that impeller 114 may extend therethrough at a level above planar portion 120.

Fan housing 118 according to the teachings of the present invention generally includes a planar annular portion 128 of a size and shape for receipt on planar portion 120 of air barrier 116. Further included is a spiral diffuser 130 integrally formed and spiraling from a central, cylindrical fan chamber 132. A central opening 133 is provided in fan chamber 132 of a size less than impeller 114 and for receiving shaft 22 of motor 20 and providing an air entrance for fan chamber 132. Diffuser 130 terminates in a vertically arranged opening 134 including a rectangular stepped portion 136. Annular portion 128 further includes an integral ramp portion 138 in line with opening 134 for directing air current and dust and dirt therein upwardly. Fan housing 118 further includes a port portion 140 for receipt upon stepped portion 136 and ramp portion 138 for forming a horizontally arranged opening 142. Planar portion 92 of shield 86 includes a deflector 144 in air communication with opening 142 of fan housing 118 having a tube 120 for attachment to a dust collection and filter device 148 such as a vacuum filter bag as shown. Air barrier 116 is secured to fan housing 118 which in turn is secured in a spaced condition from shield 86 by bolts 150 having stand off spacers 152 located between planar portion 92 and annular portion 128. In the most preferred form, planar portion 120 and annular portion 128 include recess bosses 154 and 156, respectively, for recessing the nuts of bolts 150 allowing a compact arrangement and to insure proper angular orientation of air barrier 116 and fan housing 118 during assembly. Apertures 158 having sealing plugs 160 are provided in chamber 132 around opening 133 for providing access to bolts 88 through the central opening of air barrier 116 when polishing member 16 is removed from shaft 22. Suitable sealing provisions may be provided between spiral diffuser 130 and fan chamber 132 and planar portion 120 of air barrier 116.

It can then be appreciated that when polishing member 16 is rotated by motor 20, impeller 114 of hub portion 96 of polishing member 16 rotates therewith and draws air from vacuum chamber 84 defined by and between skirts 95 and 124 and by and between flanges 94 and 122 circumferentially around and concentric with polishing member 16 and defined by and between shield 86 and centrifugal fan housing 118 and through opening 133 of centrifugal fan housing 118. The air is driven by impeller 114 in fan chamber 132 and into spiral diffuser 130 through openings 134 and 142, deflector 144, tube 146 and through bag 148 where the dust and dirt is collected as it is filtered by bag 148 from the air passing therethrough.

It is noted that the problem of dirt and dust being blown away from rotating members is well known and is especially undesirable in cleaning apparatus where the air born dust settles back onto the cleaning surface or its environment where further effort is required for removal. Prior approaches have been utilized in prior cleaning and like apparatus to solve this problem; however, it is believed that a totally unique technique to solving this problem is accomplished by the present invention and is believed to be particularly advantageous. First, the present invention allows utilization of a standard circular polishing pad and the like and specifically does not require specially manufactured working members, polishing pads or the like. Further, due to the rotation of polishing member 16, powder created by the cleaning of the floor surface by polishing member 16 tends to move outwardly to the perimeter of polishing member 16. It should then be noted that vacuum chamber 84 located concentrically of polishing member 16 is particularly advantageous as the polishing member 16 tends to deliver such floor powder to the vacuum chamber 84 for extraction under vacuum created by impeller 114. Furthermore according to the teachings of the present invention, the degree of vacuum in chamber 84 may be easily varied by adjusting skirts 95 and 124 and by changing the spacing between flanges 94 and 122.

It should further be noted that the vacuum created by vacuum chamber 84 when impeller 114 is rotating with polishing member 16 also places a downward suction to platform 18 to which shield 86, air barrier 116, and centrifugal fan housing 118 and also polishing member 16 are mounted tending to pivot lift levers 32 and 42 about pivot axis 40 and against the bias of spring 78. This effect in combination with the vacuum created by the air being forced from underneath the center of polishing member 16 and the bias of spring 78 allows for the automatic raising of polishing member 16 off the floor surface in non-rotating modes of polishing member 16 and automatic lowering of polishing member 16 to engage the floor when polishing member 16 and impeller 114 thereon are rotating and allows for the placement of even cleaning pressure on the floor surface by polishing member 16 regardless of the unevenness of the floor surface.

Now that the basic teachings of the present invention have been explained, many extensions and variations will be obvious to one having ordinary skill in the art. For example, although in the preferred embodiment according to the teachings of the present invention polishing member 16 is shown as being rotated by a battery powered motor, polishing member 16 may be rotated by other means including a motor power by outlet current.

Further, although floor polishing machine 10 in its most preferred form is shown and described as incorporating a plurality of unique, inventive aspects according to the teachings of the present invention and is believed to be particularly advantageous as producing synergistic results, one or more of these inventive aspects may be utilized in apparatus according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Machine for polishing floor surfaces comprising, in combination: a chassis adapted to be moved along the floor; a polishing member for rotation about a polishing axis for polishing the floor surface when the chassis is moved along the floor; a platform for rotatably mounting the polishing member; at least a first lift lever pivotally mounted to the chassis about a first pivot axis and having a free end pivotally mounted to the platform about a second pivot axis; a lift arm pivotally mounted to the platform about the second pivot axis; a parallelogram bar pivotally mounted to the chassis at a third pivot axis and having a free end pivotally mounted to the lift arm about a fourth pivot axis, with the first and third pivot axis lying along a vertical line and being spaced a distance, with the second and fourth pivot axis being spaced a distance equal to the spacing distance of the first and third pivot axis, with the first and second pivots axis being spaced a distance, with the third and fourth pivot axis being spaced a distance equal to the spacing distance between the first and second pivot axis, with the chassis, the lift lever, the lift arm, and the parallelogram bar forming a parallelogram for maintaining the lift arm in a vertical orientation; means for pivoting the lift lever about the first pivot axis moving the polishing member between an operating position engaging the floor surface and a transport position spaced from the floor surface, with the second pivot axis allowing the platform and the polishing member to follow the floor surface when the chassis is moved along the floor regardless of the unevenness of the floor surface.

2. The floor polishing machine of claim 1 further comprising, in combination: means for resiliently maintaining the platform at the desired angular relationship to the lift arm allowing the polishing member to be spaced from the floor surface in its transport position.

3. The floor polishing machine of claim 2 wherein the resiliently maintaining means comprises, in combination: a lift arm extension contiguous with the lift arm and extending beyond the fourth pivot axis in a direction opposite to the second pivot axis, with the platform having a front edge and a rear edge; a first spring extending between the front edge of the platform and the lift arm extension; and a second spring extending between the rear edge of the platform and the lift arm extension.

4. The floor polishing machine of claim 1 wherein the lift lever pivoting means comprises, in combination: means for biasing the lift lever to pivot about the first pivot axis for elevating the second pivot axis and for raising the polishing member off the floor surface when the polishing member is not rotating, and with the rotation of the polishing member forcing air from beneath the rotating polishing member creating a vacuum under the polishing member to place a downward suction on the polishing member and the platform to which it is rotatably mounted and counteracting with the biasing means to place an even force on the floor surface by the polishing member regardless of the unevenness of the floor surface.

5. The floor polishing machine of claim 4 wherein the lift lever biasing means comprises, in combination: a lever extension contiguous with the first lift lever and extending beyond the first pivot axis in a direction opposite to the second pivot axis and having a free end; and means for biasing the free end of the lever extension.

6. The floor polishing machine of claim 5 further comprising, in combination: means for varying the bias of the lever extension biasing means.

7. The floor polishing machine of claim 6 wherein the lever extension biasing means comprises, in combination: a lift rod reciprocally, vertically mounted in the chassis, with the first end of the lift rod being pivotally connected to the free end of the lever extension; and means for biasing the lift rod.

8. The floor polishing machine of claim 7 wherein the bias varying means comprises, in combination: an adjustment lever pivotally mounted to the chassis between its first and second ends, with the biasing means engaging the first end of the adjustment lever; and means for holding the second end of the adjustment lever in one of a plurality of pivotal positions.

9. The floor polishing machine of claim 5 further comprising, in combination: a second lift lever pivotally mounted to the chassis about the first pivot axis and having a free end pivotally mounted to the platform about the second pivot axis; a second lever extension contiguous with the second lift lever and extending beyond the first pivot axis in a direction opposite to the second pivot axis and having a free end; a connecting member secured to the free end of the first lever extension and extending in a direction towards the free end of the second lever extension; an adjustment arm extending from the connecting member generally parallel to the second lever extension and having a free end pivotally mounted to the chassis about the first pivot axis; and means for adjusting the angular orientation of the second lever extension and the adjustment arm about the first pivot axis allowing the free end of the second lift lever to be raised or lowered such that the engagement of the polishing member with the floor can be varied to allow the polishing member to propel the chassis along the floor.

10. The floor polishing machine of claim 1 further comprising, in combination: a device for controlling and collecting dust from the polishing member, with the polishing member having a perimeter, with the dust controlling and collecting device comprising, in combination: a vacuum chamber located concentrically around the perimeter of the polishing member; means for receipt of dust ladened air and for filtering the dust therefrom; a pressurizing chamber having an inlet in air communication with the vacuum chamber and an exhaust in air communication with the dust receipt and filtering means; and means located in the pressurizing chamber for drawing air through the inlet and forcing the air through the exhaust with the dust produced by the rotating polishing member moving outwardly to the perimeter of the polishing member due to its rotation and drawn with the air through the vacuum chamber and the pressurizing chamber for collection in the dust receipt and filtering means.

11. The floor polishing machine of claim 10 further comprising, in combination: a shield for the polishing member, with the shield including a planar portion and a downwardly extending flange, with the pressurizing chamber including a downwardly extending flange of a size generally equal to but slightly larger than the polishing member, with the flange of the shield having a shape for receipt around the flange of the pressurizing chamber, with the vacuum chamber being defined by and between the shield and the pressurizing chamber.

12. Machine for polishing floor surfaces comprising, in combination: a chassis adapted to be moved along the floor; a polishing member for rotation about a polishing axis for polishing the floor surface when the chassis is moved along the floor; a platform for rotatably mounting the polishing member; at least a first lift lever pivotally mounted to the chassis about a first pivot axis and having a free end attached to the platform; a lever extension contiguous with the first lift lever and extending beyond the first pivot axis in a direction opposite to the free end of the first lift lever, with the lever extension having a free end; and means for biasing the free end of the lever extension for raising the polishing member off the floor surface when the polishing member is not rotating, with the rotation of the polishing member forcing air from beneath the rotating polishing member creating a vacuum under the polishing member to place a downward suction on the polishing member and the platform to which it is rotatably mounted and counteracting with the biasing means to place an even force on the floor surface by the polishing member regardless of the unevenness of the floor surface.

13. The floor polishing machine of claim 12 wherein the lever extension biasing means comprises, in combination: a lift rod reciprocally, vertically mounted in the chassis, with the first end of the lift rod being pivotally connected to the free end of the lever extension; and means for biasing the lift rod.

14. The floor polishing machine of claim 13 further comprising, in combination: means for varying the bias of the lift rod biasing means.

15. The floor polishing machine of claim 14 wherein the bias varying means comprises, in combination: an adjustment lever pivotally mounted to the chassis between its first and second ends, with the biasing means engaging the first end of the adjustment lever; and means for holding the second end of the adjustment lever in one of a plurality of pivotal positions.

16. The floor polishing machine of claim 12 further comprising, in combination: a second lift lever pivotally mounted to the chassis about the first pivot axis and having a free end attached to the platform; a second lever extension contiguous with the second lift lever and extending beyond the first pivot axis in a direction opposite to the free end of the second lift lever, with the second lever extension having a free end; a connecting member secured to the free end of the first lever extension and extending in a direction towards the free end of the second lever extension; an adjustment arm extending from the connecting member generally parallel to the second lever extension and having a free end pivotally mounted to the chassis about the first pivot axis; and means for adjusting the angular orientation of the second lever extension and the adjustment arm about the first pivot axis allowing the free end of the second lift lever to be raised or lowered such that the engagement of the polishing member with the floor can be varied to allow the polishing member to propel the chassis along the floor.

17. The floor polishing machine of claim 12 further comprising, in combination: a device for controlling and collecting dust from the polishing member, with the polishing member having a perimeter, with the dust controlling and collecting device comprising, in combination: a vacuum chamber located concentrically around the perimeter of the polishing member; means for receipt of dust ladened air and for filtering the dust therefrom; a pressurizing chamber having an inlet in air communication with the vacuum chamber and an exhaust in air communication with the dust receipt and filtering means; and means located in the pressurizing chamber for drawing air through the inlet and forcing the air through the exhaust with the dust produced by the rotating polishing member moving outwardly to the perimeter of the polishing member due to its rotation and drawn with the air through the vacuum chamber and the pressurizing chamber for collection in the dust receipt and filtering means.

18. The floor polishing machine of claim 17 further comprising, in combination: a shield for the polishing member, with the shield including a planar portion and a downwardly extending flange, with the pressurizing chamber including a downwardly extending flange of a size generally equal to but slightly larger than the polishing member, with the flange of the shield having a shape for receipt around the flange of the pressurizing chamber, with the vacuum chamber being defined by and between the shield and the pressurizing chamber.

19. In a machine including a rotating working member which produces dust, with the rotating working member having a top and a perimeter, a device for controlling and collecting dust comprising, in combination: a vacuum chamber located concentrically around the perimeter of the rotating working member; means for receipt of dust ladened air and for filtering the dust therefrom; a pressurizing chamber having an inlet in air communication with the vacuum chamber and an exhaust in air communication with the dust receipt and filtering means; and means located in the pressurizing chamber for drawing air through the inlet and forcing the air through the exhaust with the dust produced by the rotating working member moving outwardly to the perimeter of the working member due to its rotation and drawn with the air through the vacuum chamber and the pressurizing chamber for collection in the dust receipt and filtering means.

20. The device of claim 19 wherein the air drawing and forcing means comprises an impeller located in the pressurizing chamber and on top of the rotating working member for rotation therewith.

21. The device of claim 19 wherein the pressurizing chamber comprises, in combination: an air barrier located above the top of the rotating working member; and a centrifugal housing including a spiral diffuser upstanding from an annular portion, with the annular portion of the centrifugal housing being secured to the air barrier.

22. The device of claim 21 further comprising, in combination: a shield for the rotating working member, with the shield including a planar portion and a downwardly extending flange, with the pressurizing chamber including a downwardly extending flange of a size generally equal to but slightly larger than the rotating working member, with the flange of the shield having a shape for receipt around the flange of the pressurizing chamber, with the vacuum chamber being defined by and between the shield and the pressurizing chamber.

23. The device of claim 22 further comprising, in combination: a first flexible skirt dependingly mounted to the flange of the pressurizing chamber, with the first skirt being formed of air impervious material for preventing dust from being blown away by the rotating work member.

24. The device of claim 23 further comprising, in combination: a second flexible skirt dependingly mounted to the flange of the shield, with the second skirt being formed of filtering-type material allowing air to pass therethrough but being impervious to dust.

* * * * *